US009828202B2

(12) United States Patent
Meyerhans et al.

(10) Patent No.: US 9,828,202 B2
(45) Date of Patent: Nov. 28, 2017

(54) APPARATUS AND METHOD FOR FORMING A STACK OF ADVERTISING MATERIAL COMPILATIONS

(71) Applicant: MUELLER MARTINI HOLDING AG, Hergiswil (CH)

(72) Inventors: Rolf Meyerhans, Reiden (CH); Roger Lüscher, Sursee (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/201,100

(22) Filed: Jul. 1, 2016

(65) Prior Publication Data

US 2017/0008720 A1 Jan. 12, 2017

(30) Foreign Application Priority Data

Jul. 6, 2015 (CH) ..... 0983/15

(51) Int. Cl.
*B65H 39/02* (2006.01)
*B65H 29/28* (2006.01)
(Continued)

(52) U.S. Cl.
CPC ..... *B65H 29/28* (2013.01); *B65H 29/003* (2013.01); *B65H 29/02* (2013.01); *B65H 29/06* (2013.01);
(Continued)

(58) Field of Classification Search
CPC ..... B65H 29/003; B65H 29/02; B65H 29/06; B65H 29/28; B65H 2405/53; B65H 2405/531
See application file for complete search history.

(56) References Cited

U.S. PATENT DOCUMENTS 5,141,221 A * 8/1992 Mack ..... B65H 29/68 271/203
5,452,886 A * 9/1995 Cote ..... B65H 29/06 271/187
(Continued)

FOREIGN PATENT DOCUMENTS

EP 2168894 A2 3/2010

OTHER PUBLICATIONS

European Search Report for related EP Application No. 16176673.8, dated Nov. 28, 2016.
International Search Report for CH 00983/15, dated Oct. 8, 2015.

*Primary Examiner* — Jeremy R Severson
(74) *Attorney, Agent, or Firm* — FisherBroyles, LLP; Robert Kinberg

(57) ABSTRACT

An apparatus and method for forming a stack with advertising material compilations respectively consisting of an envelope with inserts therein, and having a common, leading folded edge. The apparatus includes a feed conveyor, a transfer conveyor and a stacking device. The transfer conveyor comprises a central wheel that rotates around a first rotational axis, a carrier wheel that rotates around a second rotational axis oriented parallel to the first rotational axis, and a number of pivoting arms with respectively one gripper. The second rotational axis is arranged below a horizontal plane extending through the first rotational axis. The grippers are respectively positioned on the pivoting arm to rotate around an axis. The grippers take over the advertising material compilations in a takeover region from the feed conveyor, transfer the adverting compilations in a transfer region to the stacking device which extends into the transfer region and deposit these on the stacking device.

21 Claims, 6 Drawing Sheets

(51) Int. Cl.

| | |
|---|---|
| ***B65H 29/02*** | (2006.01) |
| ***B65H 29/00*** | (2006.01) |
| ***B65H 29/06*** | (2006.01) |
| ***B65H 29/68*** | (2006.01) |
| ***B65H 31/10*** | (2006.01) |

(52) U.S. Cl.

CPC ..... *B65H 29/68* (2013.01); *B65H 31/10* (2013.01); *B65H 2301/4212* (2013.01); *B65H 2403/42* (2013.01); *B65H 2403/44* (2013.01); *B65H 2403/51* (2013.01); *B65H 2405/53* (2013.01); *B65H 2405/531* (2013.01); *B65H 2701/1916* (2013.01); *B65H 2701/1932* (2013.01)

(56) References Cited

U.S. PATENT DOCUMENTS

| | | | | |
|---|---|---|---|---|
| 6,116,593 | A | 9/2000 | Cote et al. | |
| 7,422,212 | B2 * | 9/2008 | Noll, Jr. ..... | B65H 29/06 271/244 |
| 8,056,705 | B2 * | 11/2011 | Stauber ..... | B42B 4/00 198/459.2 |
| 2002/0153228 | A1 | 10/2002 | Kramer | |
| 2007/0001381 | A1 * | 1/2007 | Noll, Jr. ..... | B65H 29/06 271/160 |

* cited by examiner

APPARATUS AND METHOD FOR FORMING A STACK OF ADVERTISING MATERIAL COMPILATIONS

CROSS-REFERENCE TO RELATED APPLICATION

This application claims priority to Swiss Application No. 00983/15, filed Jul. 6, 2015, the content of which is incorporated herein by reference in its entirety.

BACKGROUND OF THE INVENTION

The invention relates to an apparatus and a method for forming a stack of compiled advertising materials, respectively composed of an envelope and inserts, having a common, leading folded edge, the apparatus comprising a machine frame, a thereto attached circular transfer conveyor that circulates, a feed conveyor arranged upstream of the transfer conveyor and a stacking device arranged downstream of the transfer conveyor.

Swiss application No. CH 00073/15 describes a method and a corresponding apparatus for combining an envelope and several inserts to form a compilation of advertising materials. The envelopes and the inserts are deposited individually and successively one on top of the other in a gathering section of a conveying element that is moving in a transporting direction. For this, an envelope is deposited with the leading edge offset to the leading edges of the inserts in the conveying direction, so that the edge of the envelope projects relative to the inserts. The inserts are stacked one on top of the other so that the leading edges of the inserts form at least approximately a common folded edge, wherein the projecting section of the envelope which rests flat on the conveying element is folded over this common folded edge, as well as at least partially around the stack of gathered inserts, thereby forming the advertising material compilation. The compiled advertising materials are then folded along the folded edge and are conveyed further for the post processing. Together with the same or different advertising material compilations, they are generally sent to a supermarket chain and finally distributed to the customers.

For the purpose of a further processing, an automatic stacking operation of several such advertising material compilations, respectively composed of one envelope, inserts and having a common, leading folded edge, therefore makes sense. Advertising material compilations of this type, the content of which is frequently loose or can be separated easily, must therefore be treated carefully during the post-processing, so that the components are not separated before reaching the final customer. Compiled advertising materials that separate easily are understood to be compilations of individual advertising materials, such as brochures, goods samples, coupons and the like which, during the transport, are held together based on an earlier gluing operation, e.g. along several gluing points, until they are separated by the final customer for reading.

Also known is a post processing of individual signatures or printed sheets combined into a book block, which are supplied positioned flat or suspended to a transfer conveyor and are transferred from said conveyor to a downstream transport or further processing device.

European patent document EP2168894 A2 thus relates to an apparatus and a method for separating printed products supplied suspended in a compact formation by using a circular, circulating transfer conveyor and subsequently transferring these to a discharge device embodied as a conveying belt. The separating of the printed products occurs in an upstream takeover region and the discharge in a downstream transfer region. The transfer conveyor is provided for this with a rotating body in the form of a central wheel, having an axis of rotation and eight pivoting arms respectively provided with a gripper, as well as with an outer carrier wheel that is also embodied as a rotating body with a second axis and a guide mechanism for adjusting the pivoting position of the pivoting arms. The central wheel is connected to a first drive and the carrier wheel to a second drive. A third drive is also used for adjusting the two axes, so that the transfer conveyor can be switched from the operation with a coaxial drive to an operation with eccentrically arranged rotational bodies. With the coaxial operation, all pivoting arms are arranged equidistant, whereas the pivoting arms are at a shorter distance to each other in the upper region of the transfer conveyor and at a longer distance in the lower region. By correspondingly displacing the guide mechanism, the transfer conveyor can be adapted to different formats of the printed products, so that these can be turned over with the required speed to the discharge conveyor. Since the guide mechanism is relatively expensive and involved, it results in an expensive and relatively large design for the apparatus. In addition, the use of several drives is also expensive and the failure of a single drive train can result in the loss of synchronicity and increased repair costs. Finally, with an apparatus of this type, a reduction in speed in the transfer region of the grippers attached to the pivoting arms and thus the printed products transported therewith is not possible owing to the increased spacing in the lower region of the transfer conveyor and thus the increased speed of the pivoting arms. An apparatus of this type and the corresponding method are therefore not suitable for forming a stack with compiled advertising materials, composed of an envelope and inserts and having a common, leading folded edge and, in particular, not for forming a stack of loose or easily separated advertising material compilations.

With this solution, the compiled advertising materials are furthermore gripped by the grippers of the feed conveyor on the open side and by the grippers of the transfer conveyor along the folded edge. Such a combination of a feed conveyor and transfer conveyor consequently does not allow a suspended feeding of loose or easily separated advertising material compilations for which the compiled advertising materials while only partially enclosed by an envelope are taken over by the gripper of the transfer conveyor along the folded edge because the compiled advertising materials, which can also have different formats for the inserts and the envelope, can fall apart while being gripped along the open side by the gripper of the feed conveyor.

A similar transfer conveyor is described in U.S. Pat. No. 7,422,212 B2. This conveyor is used for the transport of folded envelopes for newspapers with the aid of a feed conveyor arranged upstream of the transfer conveyor and transported by the grippers while suspended to a conveyor for the further transport, which is arranged downstream of the transfer conveyor, on which the printed products are deposited individually and positioned flat in a transfer region. The envelopes form pockets in this case for accommodating the inserts and enclosing these on three sides, wherein the envelopes are held along the open side by the feed conveyor gripper.

The transfer conveyor comprises pivoting arms, arranged on a circular wheel positioned eccentrically in a circular frame, which are provided with respectively one gripper at the opposite outer end. The grippers of the transfer conveyor can be swiveled around a joint with respect to their orientation to the pivoting arms. The pivoting arms comprise a guiding element, which is guided along an outer ring arranged along the circumference of the transfer conveyor. A guide mechanism of this type, arranged in the outer ring, has relatively large dimensions requiring an involved production and is therefore relatively expensive to produce. A reduction in speed of the grippers arranged on the pivoting arms and thus the advertising material compilations held by the grippers cannot be achieved in the transfer region with such an apparatus because of the larger spacing in the lower region and the resulting increased speed of the pivoting arms.

With this solution, the compiled advertising materials are also gripped by the feed conveyor grippers along the open side and along the folded edge by the transfer conveyor grippers. A combination of feed conveyor and transfer conveyor of this type consequently also does not permit a suspended feeding of loose or easily separated advertising material compilations, wherein the advertising material compilations are only partially enclosed by an envelope and are taken over by the transfer conveyor gripper along the folded edge. That is the case because the compiled advertising materials, which can have different formats for inserts and envelopes, can already come apart while being gripped along the open side by the feed conveyor grippers.

The known apparatuses therefore require a large amount of space, have relatively involved designs and do not permit a sufficiently careful stacking of advertising material compilations with respectively one envelope, inserts and having a common, leading folded edge and, in particular, not of loose or easily separated advertising material compilations. The inserts can be composed of printed products or other types of promotional materials. An apparatus of this type and the corresponding method are consequently not suitable for forming a stack of such compiled advertising materials. The same is also true for the method realized with these apparatuses.

SUMMARY OF THE INVENTION

It is an object of the invention to provide a compact, cost-effective apparatus and a method for forming a stack with compiled advertising materials, composed of an envelope and inserts and having a common, leading folded edge, which ensure a gentle stacking of the materials.

The above and other object are achieved according to one embodiment by the provision of an apparatus for forming a stack with advertising material compilations composed of, respectively, an envelope with inserts, the envelope having a common, leading folded edge, the apparatus comprising: a machine frame; a circulating transfer conveyor having a circular shape connected to the machine frame, wherein the transfer conveyor comprises: a central wheel attached to the machine frame for rotation around a first rotational axis; a carrier wheel attached to the machine frame for rotation around a second rotational axis that is oriented in a direction parallel to the first rotational axis; a number of pivoting arms radially arranged on the carrier wheel, each pivoting arm including: an inside end respectively arranged to rotate on the central wheel; an outside end and a gripper attached to the outside end for rotation around an axis on the pivoting arm; and a number of guide elements positioned on the carrier wheel for, respectively, slidingly accommodating one of the pivoting arms, the second rotational axis being arranged to extend below a horizontal plane through the first rotational axis; a feed conveyor arranged upstream of the transfer conveyor; and a stacking device arranged downstream of the transfer conveyor; wherein the transfer conveyor is adapted so that the advertising material compilations are taken over by the grippers of the transfer conveyor from the feed conveyor in a takeover region of the transfer conveyor, and the advertising material compilations are transferred in a transfer region of the transfer conveyor by the grippers of the transfer conveyor to the stacking device which extends into the transfer region.

The transfer conveyor of the above-described type thus comprises a central wheel attached to the machine frame, which rotates around a first rotational axis, a carrier wheel that is also attached to the machine frame and rotates around a second rotational axis that is oriented in a direction parallel to the first rotational axis, as well as a number of pivoting arms which are respectively attached with the inside end to the central wheel, so as to swivel, and which are provided on the outside end with respectively one gripper. A number of guide elements for the sliding hold of respectively one pivoting arm are furthermore positioned rotating on the carrier wheel. The second rotational axis furthermore extends below a horizontal plane through the first rotational axis and may additionally be offset to a position offset to a side of the first rotational axis. The grippers are furthermore positioned rotating around an axis on the pivoting arm. Finally, the transfer conveyor comprises a takeover region and a transfer region, wherein the compiled advertising materials are taken over in the takeover region by the grippers of the transfer conveyor from the feed conveyor and are transferred in the transfer region by the grippers of the transfer conveyor to the stacking device. The stacking device is arranged so as to engage in the transfer region.

Owing to the rotating positioning of the grippers on their pivoting arm, the grippers can be adapted for the takeover of the advertising material compilations from the feed conveyor as well as the transfer of the advertising material compilations to the stacking device. A careful transport of the advertising material compilations can thus be ensured. This is supported by the eccentric arrangement of the rotational axes of the central wheel and the carrier wheel, as well as the arrangement of the second rotational axis below a horizontal plane through the first rotational axis, which leads in the transfer region to a reduction of the spacing between adjacent grippers and thus to a reduction of the speed for the grippers and finally to a reduction in the speed of the compiled advertising materials during the transfer to the stacking device. Finally, the positioning of the stacking device which extends into the transfer region also ensures a relatively soft depositing of the advertising material compilations on the stacking device. The eccentric arrangement of the rotational axes for the central wheel and the carrier wheel, as well as the arrangement of the second rotational axis below a horizontal plane through the first rotational axis, furthermore results in an increase of the spacing between adjacent grippers in the takeover region, so that a collision between the advertising material compilations and the grippers can be avoided.

According to one embodiment of the inventive apparatus, the envelope and the inserts of the advertising material compilations are compiled loosely or easy to separate. Owing to the careful and collision-free transport, this apparatus is also suitable for stacking advertising materials which can easily drop out of the advertising material compilations.

According to a further embodiment of the inventive apparatus, an upper opening and closing cam curve for opening the grippers prior to reaching the takeover region and for closing the grippers on leaving the takeover region, as well as a lower opening and closing cam curve for opening and again closing the grippers in the transfer region are arranged on the machine frame of the apparatus or connected thereto and/or are arranged on a component of the apparatus that does not rotate along with the transfer conveyor. In this way, the opening and/or closing of the grippers can be realized with simple control elements.

For a further embodiment of the inventive apparatus, the upper as well as the lower opening and closing cam curves are designed such that they can be adjusted and/or replaced, so that they can advantageously be adapted to different advertising material compilations, for example having different thicknesses, different types of paper and different formats.

According to yet another embodiment of the inventive apparatus, the central wheel and the carrier wheel are driven with the aid of a single drive and a joint power transfer element, in particular a toothed gearing. A simple, cost-effective and space-saving solution can thus be realized.

According to yet another embodiment of the inventive apparatus, the central wheel is provided with an outside toothing and the carrier wheel with an inside toothing while the power transmission element, embodied as toothed gearing, is designed to engage in the outside toothing and the inside toothing. The power transmission element embodied as toothed gearing is furthermore arranged between the central wheel and the carrier wheel. This configuration supports the compact design.

According to a different embodiment of the inventive apparatus, the feed conveyor comprises at least one conveying element with a feeding plane for the advertising material compilations, wherein the feeding plane is oriented parallel to the rotational axis of the central wheel and tangential to the movement path of the grippers, and the stacking device is arranged along the circumference of the transfer conveyor and comprises a depositing plane that is oriented parallel to the rotational axis of the central wheel and horizontal or at an acute angle to a horizontal line. This ensures a secure, careful and interruption-free takeover and transfer of the advertising material compilations.

According to a different embodiment of the inventive apparatus, the second rotational axis is arranged below a horizontal plane through the first rotational axis and with an offset to the side. In this way, the takeover region and the transfer region can be positioned flexible along the circumference of the transfer conveyor.

The carrier wheel of yet another embodiment of the inventive apparatus comprises two spaced-apart but connected rings. Recesses are furthermore worked into the circumference of the rings for accommodating the guide elements. The resulting, relatively stiff structure of the carrier wheel ensures a longer service life of this component and a movement without play of the pivoting arms.

Another embodiment of the inventive apparatus provides for an adjustment element to be positioned on each pivoting arm. In this way, a control cam for changing the gripper position can be arranged in the region of the central wheel on the machine frame, thereby aiding a compact design.

The carrier wheel of a different embodiment of the inventive apparatus is configured to completely enclose the central wheel in radial direction, wherein this design also supports a compact configuration of the inventive apparatus.

According to another aspect of the invention, there is provided a method for forming a stack of advertising material compilations composed of, respectively, an envelope, inserts inside the envelope, and having a common, leading folded edge, employing an apparatus including a machine frame a thereto attached circulating transfer conveyor in the shape of a circle, a feed conveyor arranged upstream of the transfer conveyor, and a stacking device arranged downstream of the transfer conveyor, wherein the transfer conveyor includes a central wheel that rotates around a first rotational axis and is attached to the machine frame, a carrier wheel that rotates around a second rotational axis that is oriented in a direction parallel to the first rotational axis and is also attached to the support frame, and a number of pivoting arms respectively arranged with an inside end on the central wheel so as to rotate, and which include respectively one gripper on an outside end of the pivot arm, the method comprising: taking over the advertising material compilations from the feed conveyor by the grippers of the transfer conveyor in a takeover region of the transfer conveyor; subsequently transporting, by the grippers of the transfer conveyor, the advertising material compilations to the stacking device in a transfer region of the transfer conveyor, while during the transporting reducing a spacing between adjacent grippers and transporting the advertising material compilations at a reduced speed to the stacking device, and depositing the advertising material compilations on the stacking device; subsequently, and until a renewed entry into the takeover region, increasing the spacing between the adjacent grippers; and swiveling the grippers relative to their pivoting arm in the takeover region and in the transfer region for alignment with the feed conveyor and the stacking device, respectively.

Accordingly, with the method according to the invention, the grippers of the transfer conveyor take over the advertising material compilations in a takeover region from the feed conveyor, subsequently transport the advertising material compilations to a transfer region and the stacking device, wherein the spacing between adjacent grippers is reduced and the advertising material compilations are transferred at a reduced speed to the stacking device and deposited thereon. The spacing between adjacent grippers then increases again, up to the renewed entry into the takeover region. In the takeover region as well as in the transfer region, the grippers are pivoted on the pivoting arm to align them with the feed conveyor and/or the stacking device, thus permitting a material-saving stacking of the advertising material compilations.

According to another variant of the inventive method, advertising material compilations are advantageously used wherein the envelope and the inserts are compiled loosely or easily separated.

DETAILED DESCRIPTION

Figures 1, 1A, 1B:
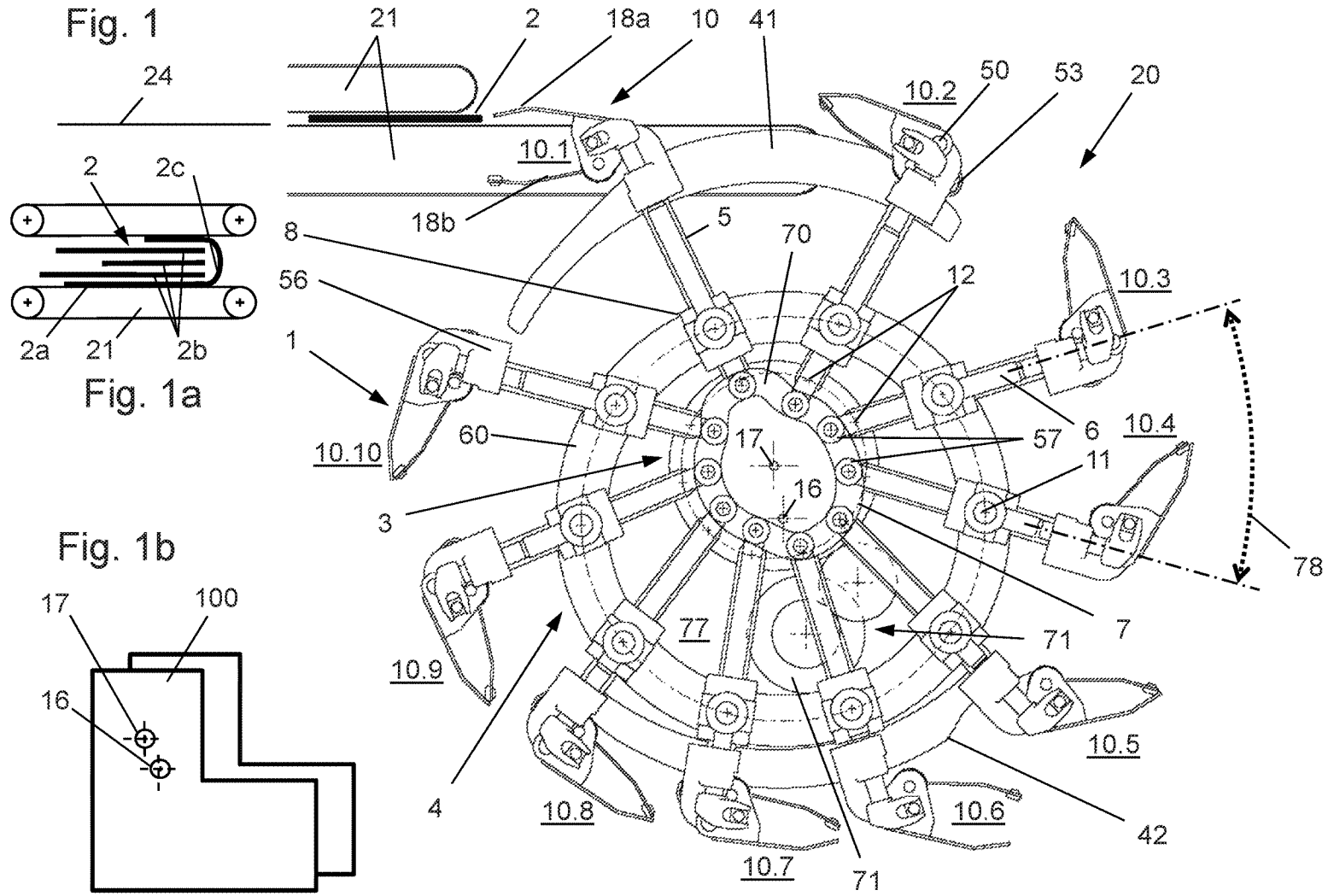
FIG. 1 shows a schematic representation of the apparatus according to the invention in a view from the side.
FIG. 1*a* shows an enlarged representation of the supplied advertising material compilations.
FIG. 1*b* shows a schematic representation of the machine frame as well as the positioning of the rotational axes for the central wheel and the carrier wheel on the machine frame.
Figure 2:
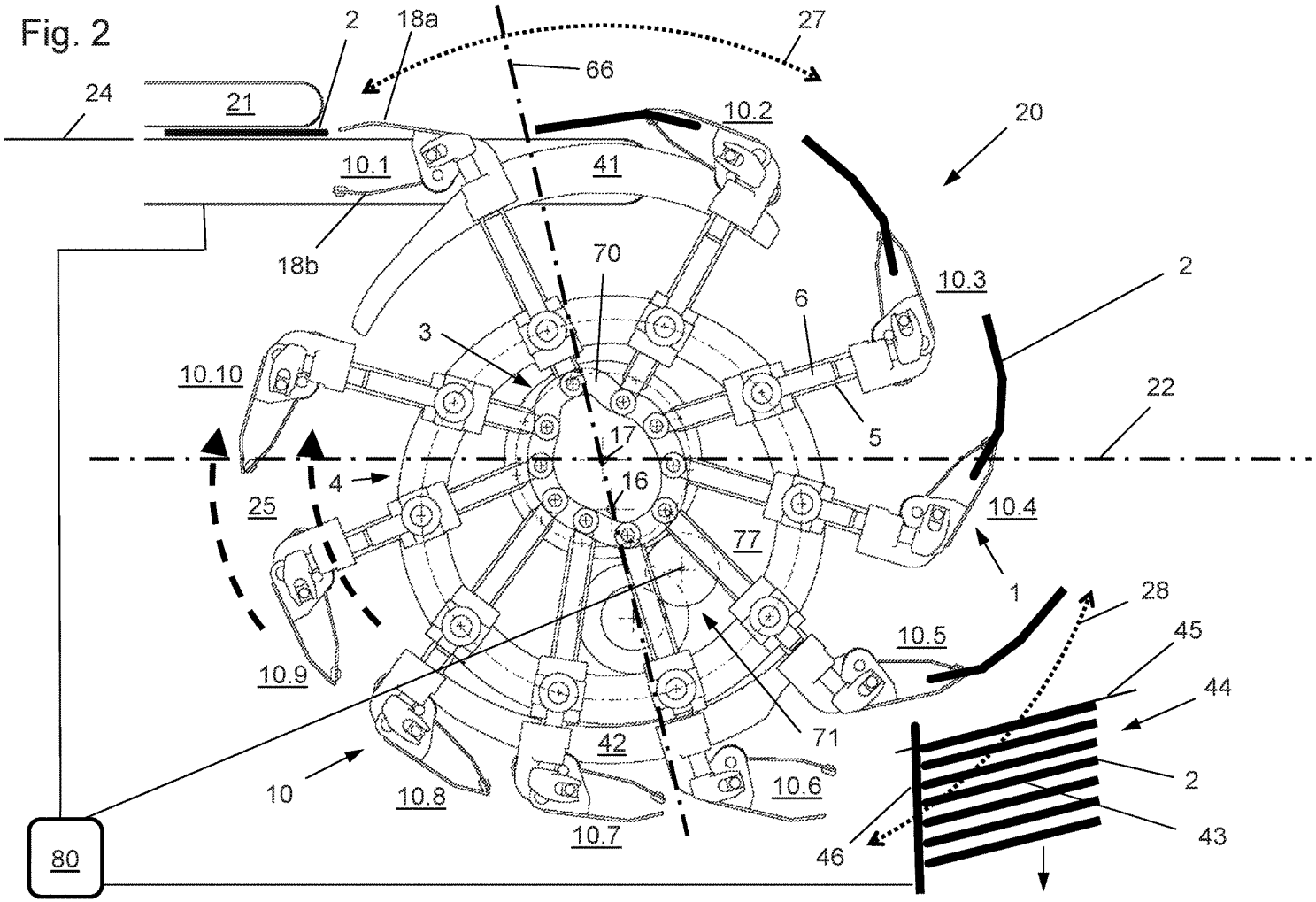
FIG. 2 shows a representation identical to FIG. 1, but additionally with the product flow.

FIG. 1 schematically represents an embodiment of a device for forming a stack 43 (FIG. 2), composed of loose or easy to separate compiled advertising materials 2 with respectively one envelope 2*a*, inserts 2*b* and having a common, leading folded edge 2*c*. The apparatus comprises a circulating transfer conveyor 20, a feed conveyor 21 arranged upstream of the transfer conveyor 20 and a stacking device 44 (FIG. 2) arranged downstream of the transfer conveyor 20, which are attached to a machine frame 100 (FIG. 1*b*) and are connected to a control unit 80 (FIG. 2).

Figure 3:
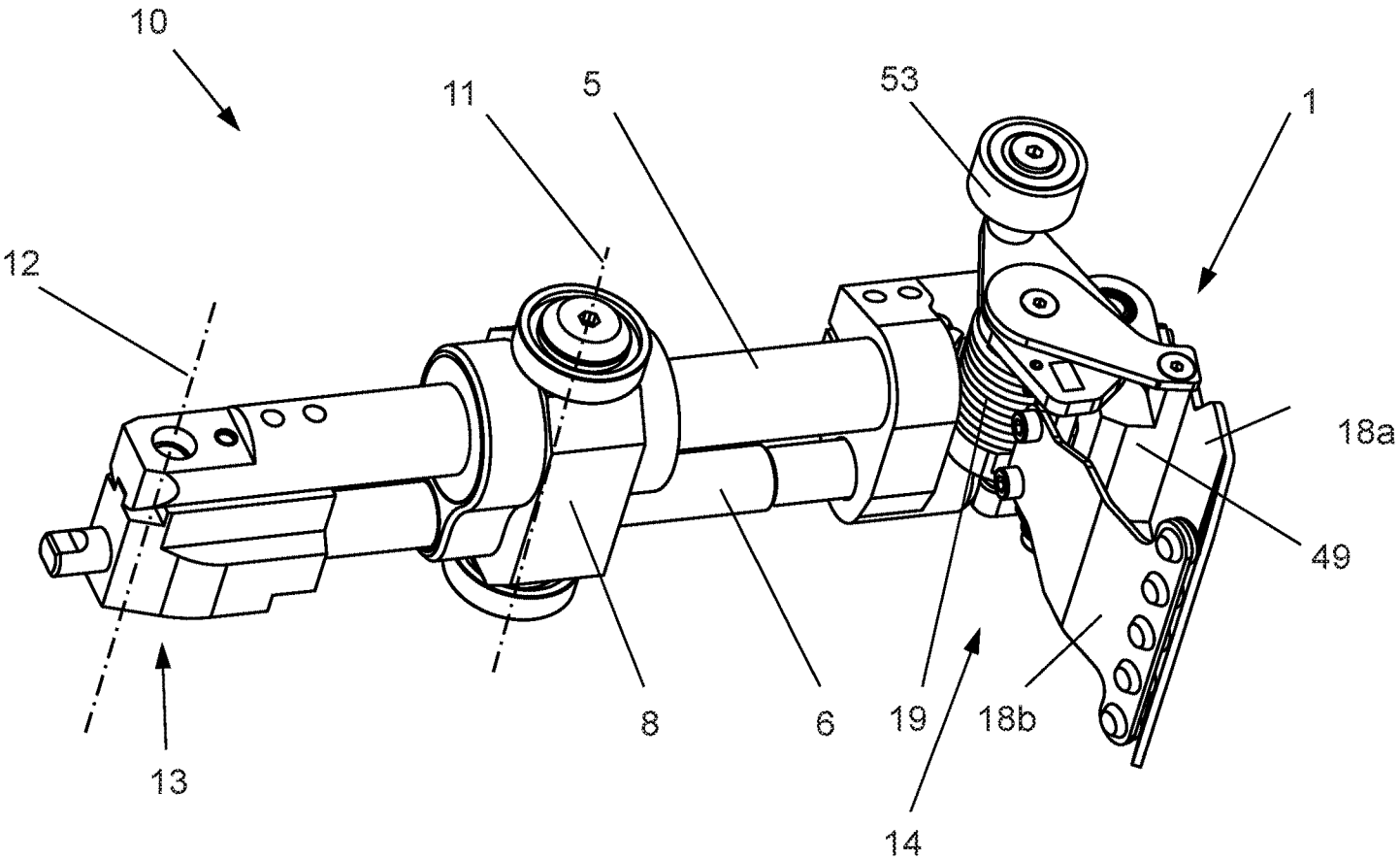
FIG. 3 shows an enlarged, perspective representation of a pivoting arm from FIG. 1, as seen from behind.

The circular transfer conveyor 20 is embodied so as to circulate. Ten pivoting arms 10 (given the individual references 10.1 to 10.10) are arranged along the circumference of the transfer conveyor 20. The pivoting arms 10 shown in FIGS. 1 and 2 are elongated and comprise respectively one holding element 5 which is attached on the inside end 13 (FIG. 3) of the pivoting arm 10 to a central wheel 3, so as to rotate around and axis 12. Also conceivable are transfer conveyors 20 with more or fewer pivoting arms 10.

The central wheel 3 is embodied as a disk with a first, centrally arranged rotational axis 17 which simultaneously also represents the rotational axis of the transfer conveyor. The central wheel 3 is provided with a number of recesses 9 that are arranged uniformly spaced apart along the circumference (FIG. 6) and which correspond to the number of pivoting arms 10 of the transfer conveyor 20. Arranged in the recesses 9 are bearing elements 23, for example roller bearings or sliding bearings, which form the above-mentioned axis 12 to which the pivoting arms 10 are attached and around which these pivot. The central wheel 3, for example, is positioned on a shaft 47 that is connected to the machine frame 100, a shaft journal or an axle.

A gripper 1 which can pivot around another axis 50 of the holding element 5 is attached to a radially outside positioned end 14 of the pivoting arm 10, which gripper is used to clamp in and transport the compiled advertising materials 2.

The grippers 1 are respectively provided with a clamping body 49 (FIG. 3), having a first clamping jaw 18*a* which can be pivoted around the axis 50 (FIG. 4) at a specific angle, relative to the holding element 5. The grippers 1 furthermore comprise a second clamping jaw 18*b* that is pressed with the aid of a prestressed elastic element 19 (FIG. 3), e.g. a torsion spring, against the first clamping jaw 18*a*. With the aid of a cam follower 53, which is connected to the second clamping jaw 18*b* and cooperates with an upper, locally fixed opening and closing cam curve 41 and a lower, locally fixed opening and closing cam curve 42, the closing force of the elastic element 19 can be overcome and the gripper 1 can be opened. The opening and closing cam curves 41, 42 are arranged on the machine frame 100 of the apparatus or are connected to it and/or are attached to a component of the apparatus that does not rotate along with the transfer conveyor 20. To respectively adapt the point in time and/or the opening and closing operation of a gripper 1 to the characteristics of the compiled advertising materials 2 to be processed, it is advantageous if the upper opening and closing cam curve 41 and the lower opening and closing cam curve 42 can be adjusted around the axis 17, either in or counter to the rotational direction of the transfer conveyor 20. The opening and closing cam curves 41, 42 can respectively be adjusted separately or jointly, either manually or via a non-depicted adjustment element, for example an adjustment motor or fluid cylinder. Also conceivable is a simple and time-saving replacement of the opening and closing cam curves 41, 42 for adapting the point in time and/or the opening and closing operation to the characteristics of the advertising material compilations 2 to be processed. The two opening and closing cam curves 41 and 42 can furthermore also be embodied as a joint cam curve.

Figure 4:
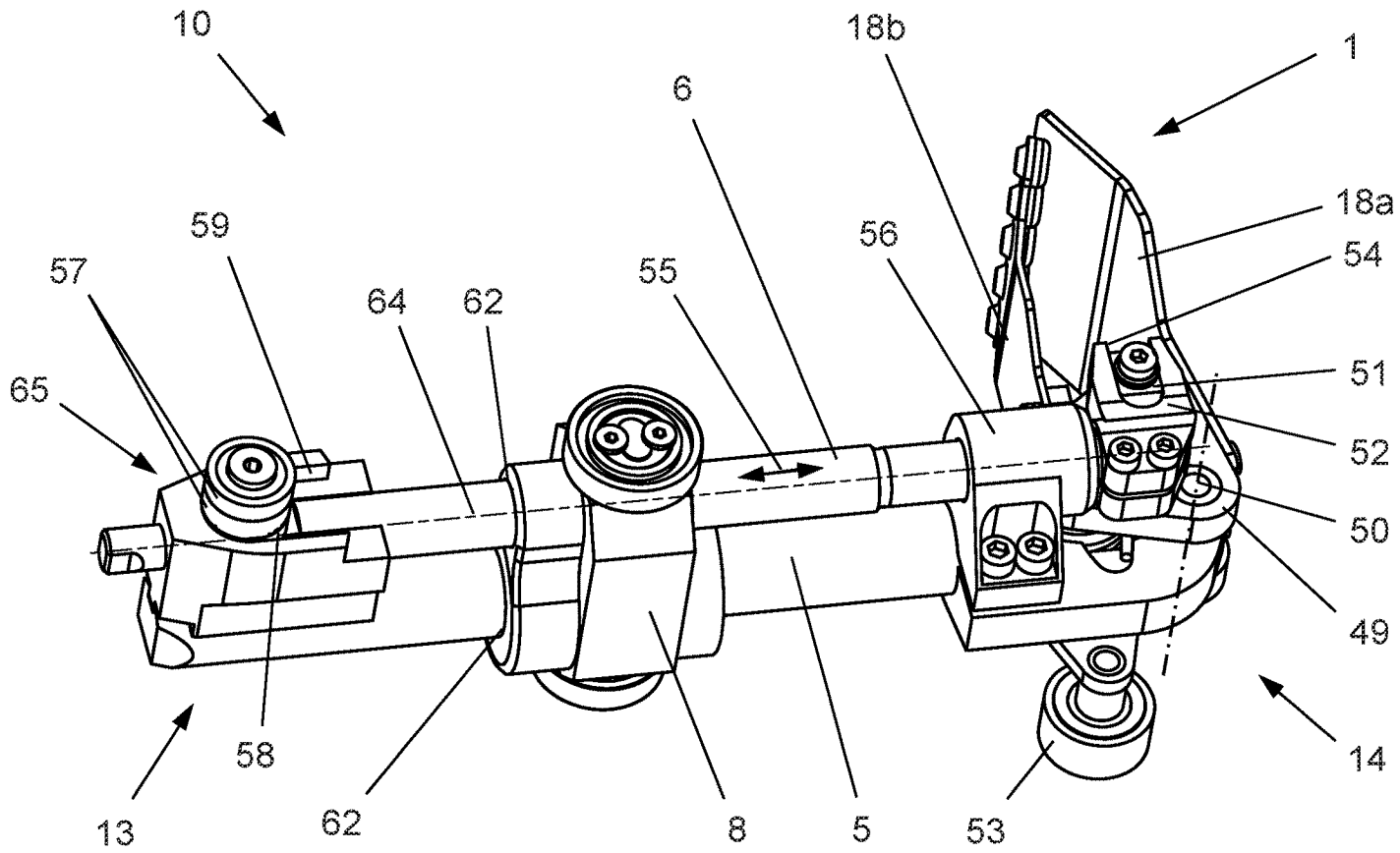
FIG. 4 shows an enlarged, perspective representation of a pivoting arm from FIG. 1, as seen from the front.

The gripper 1 is pivoted around the axis 50 of the clamping body 49 with the aid of an adjustment element 6, for example embodied as a push rod, that extends from the inside end 13 to the outside end 14 of the pivoting arm 10, meaning up to the clamping body 49. The cylindrical adjustment element 6 is positioned at the outer end 14 of the pivoting arm 10, in a bearing location 56 designed as spherical liner, displaceable in activation direction 55 (FIG. 4). Alternatively, the bearing location can also be embodied as a sliding bearing. The activation direction 55 runs parallel to a center axis 64 for the adjustment element 6. In the region of the gripper 1, the adjustment element 6 is provided with a transfer element 52 containing a recess 54. A cam 51, embodied as slide stone, is attached offset to the axis 50 on the clamping body 49, which engages in the recess 54 of the transfer element 52 and can be displaced therein with almost no play. Also conceivable is that in place of the cam 51, a pivot may be attached to the clamping body 49 or may be formed onto the clamping body 49.

On the inside end of the pivoting arm 10, meaning the end 13 located opposite the transfer element 52, the adjustment element 6 is provided with one or more cam followers 57 by which the gripper 1 can be pivoted purposely in an activation direction 55 around the axis 50 via a movement of the adjustment element 6. In the region of the central wheel 3, a locally fixed cam disc 7 is attached which is connected to the machine frame 100. As shown in FIG. 1, a closed contour line 70 with changing spacing relative to a first rotational axis 17 is worked into the cam disc 7. The cam followers 57 of the adjustment element 6 engage in the cam disc 7 and move along the complete contour line 70 if the transfer conveyor 20 rotates once by 360°.

The adjustment element 6 comprises an anti-turning device 65 (FIG. 4) which prevents the adjustment element 6 from rotating around its central axis 64 and the cam 51 from sliding on the side out of the recess 54 on the transfer element 52. For this, the pivoting arm 10 of the exemplary embodiment is provided on its inside end 13 with a recess 59 in which a roll 58 that is connected to the adjustment element 6 can move in activation direction 55 of the adjustment element 6, without permitting a turning of the adjustment element 6 around its center axis 64. An anti-turning device 65 is not necessary if the adjustment element 6 is not embodied cylindrically, but as a square bar for example. One skilled in the art, of course, is also familiar with other types of designs for realizing an anti-turning device 65 for the adjustment element 6.

Figure 5:
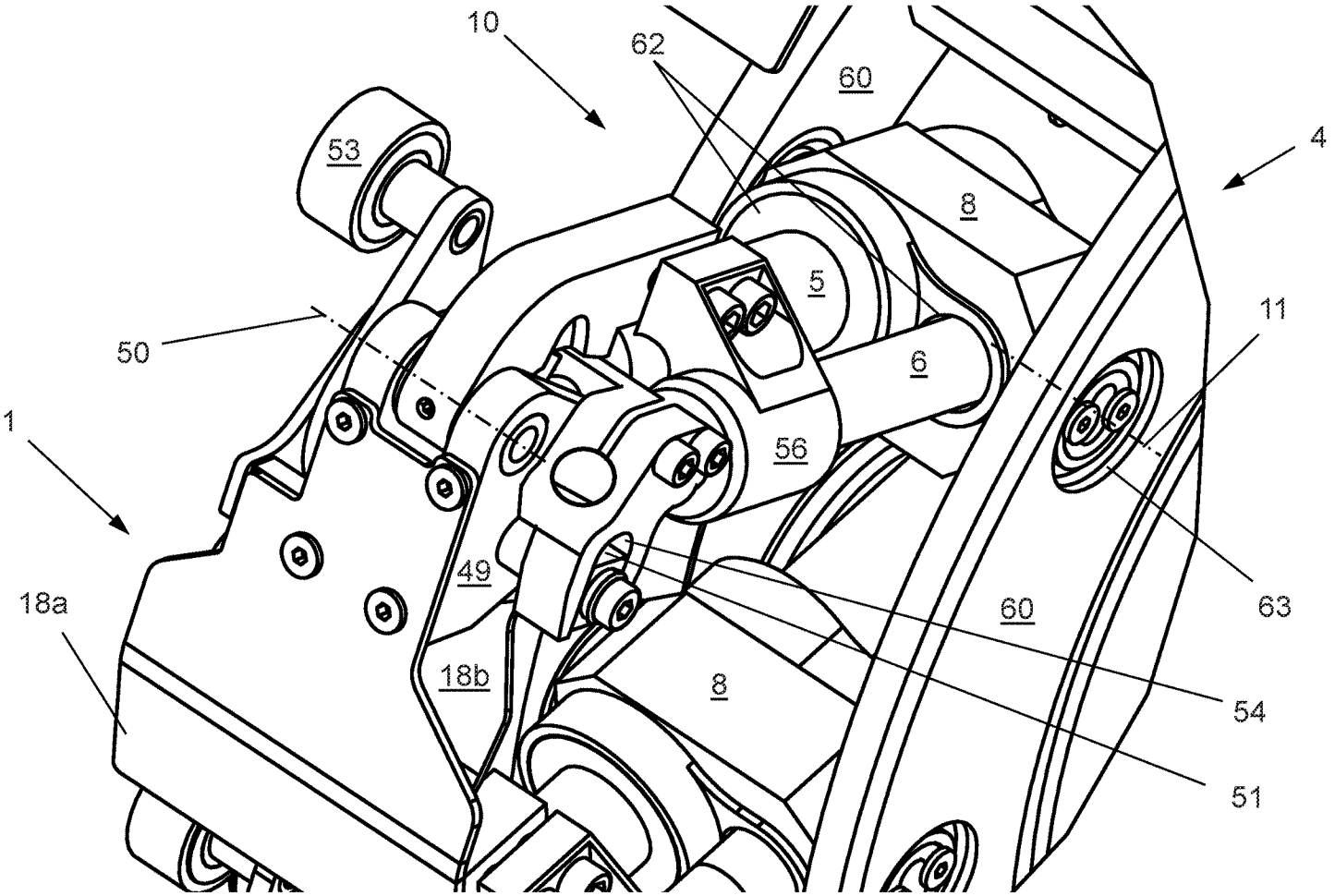
FIG. 5 shows an enlarged, perspective representation of a pivoting arm in the region of the carrier wheel and the guide element.

The transfer conveyor 20 also comprises a carrier wheel 4, consisting of two axially spaced-apart and fixedly connected rings 60 (FIG. 5). The rings 60 contain the same number of recesses 63 as the central wheel 3, and the recesses 63 are also arranged uniformly spaced apart along the rings 60. The carrier wheel 4 is positioned on the machine frame 100 and rotates around a second rotational axis 16 which is oriented in a direction that is parallel to the first rotational axis 17 of the central wheel 3. The inside diameter of the rings 60 is approximately 1.5 to 3 times the outside diameter of the central wheel 3. As can be seen from the side views in FIGS. 1 and 2, the second rotational axis 16 of the carrier wheel 4 is located below a horizontal plane 22 that extends through the rotational axis 17. In addition to being offset in downward direction, the second rotational axis 16 can also be arranged in a location transverse to the rotational axis 17 with an offset to the side, relative to the rotational axis 17. The central wheel 3 is located completely within the carrier wheel 4 in a radial direction and the two wheels 3 and 4 do not overlap and come in contact.

The carrier wheel 4 furthermore comprises a number of guide elements 8 which are arranged between the rings 60 and are positioned in the recesses 63 of the two rings 60, so as to rotate around an axis 11. The guide elements 8 are provided with two parallel bearing locations 62, embodied as spherical liners, through which the holding element 5 and the adjustment element 6 of the pivoting arm 10 extend. Alternatively, the bearing location 62 can also be embodied as sliding bearing. Owing to the rotating attachment of the pivoting arms 10 along the circumference of the central wheel 3 and the positioning of the pivoting arms 10 in the carrier wheel 4 that is arranged eccentric to the central wheel 3, the spacing 78 differs between two adjacent pairs of grippers 1 along the circumference of the transfer conveyor 20.

The rotational axis 16 of the carrier wheel 4 is advantageously arranged below the rotational axis 17 of the central wheel 4 and offset to the rotational axis 17, such that an imaginary plane 66 that extends through the two rotational axes 16, 17 also extends through a takeover region 27 in which the loose advertising material compilations 2 on the feed conveyor 21 are taken over by the respective gripper 1 of the transfer conveyor 20 (FIG. 2). A collision between a loose advertising material compilation 2 which is taken over by a gripper 1 and the following gripper 1 can thus be avoided. The transfer of the loose advertising material compilations 2 to the stacking device 44 furthermore occurs in a transfer region 28 in which the spacing 78 between two adjacent grippers 1 along the circumference of the transfer conveyor 20 is small and thus the circumferential speed of the gripper 1 is also low. The relatively low circumferential speed permits a careful transfer of the loose advertising material compilations 2 to the stacking device 44.

In general, the spacing between the grippers 1, relative to each other, is greatest in the region in which the pivoting arms 10 extend through the plane 66 above the horizontal plane 22. Accordingly, the spacing 78 is smallest in the region in which the pivoting arms 10 extends below the horizontal plane 22 through the plane 66. For the present invention, the axis of rotation 16 is offset to the side in addition to a vertical offset, relative to the rotational axis 17. The plane 66 is therefore angled slightly counter to the rotational direction of the transfer conveyor 20. The stacking device 44 is arranged along the circumference of the transfer conveyor 20, below the horizontal plane 22, and is designed to accommodate a stack 43 of advertising material compilations 2. The stacking device 44 comprises a fictional depositing plane 45 on which the advertising material compilations 2 are deposited. The depositing plane 45 is oriented parallel to the rotational axis 17 of the central wheel and horizontal or at an acute angle to the horizontal line. The stacking device 44 furthermore is provided with an end stop 46 on the side of the stack device 44 that faces the transfer conveyor 20, against which the advertising material compilations 2 released by the grippper 1 in the transfer area 28 are aligned with their folded edges 2*c*. It is advantageous in that case if the depositing plane is oriented in the direction of the end stop 46, at an acute angle to the horizontal line. The upper flat side of the top advertising material compilation 2 in the stack 43 thus fits from below against the depositing plane 45. So that the upper end of the stack 43 does not extend past the depositing plane 45, the stack 43 in the stacking device 44 is lowered in downward direction following the placement of each advertising material compilation 2 onto the stack 43. Also conceivable is that instead of a vertical stack 43, the advertising material compilations 2 form an overlapping flow, with the advertising material compilations 2 not completely overlapping, on a non-depicted conveying element of the stacking device 44 which is moving away from the transfer region 28.

Figure 6:
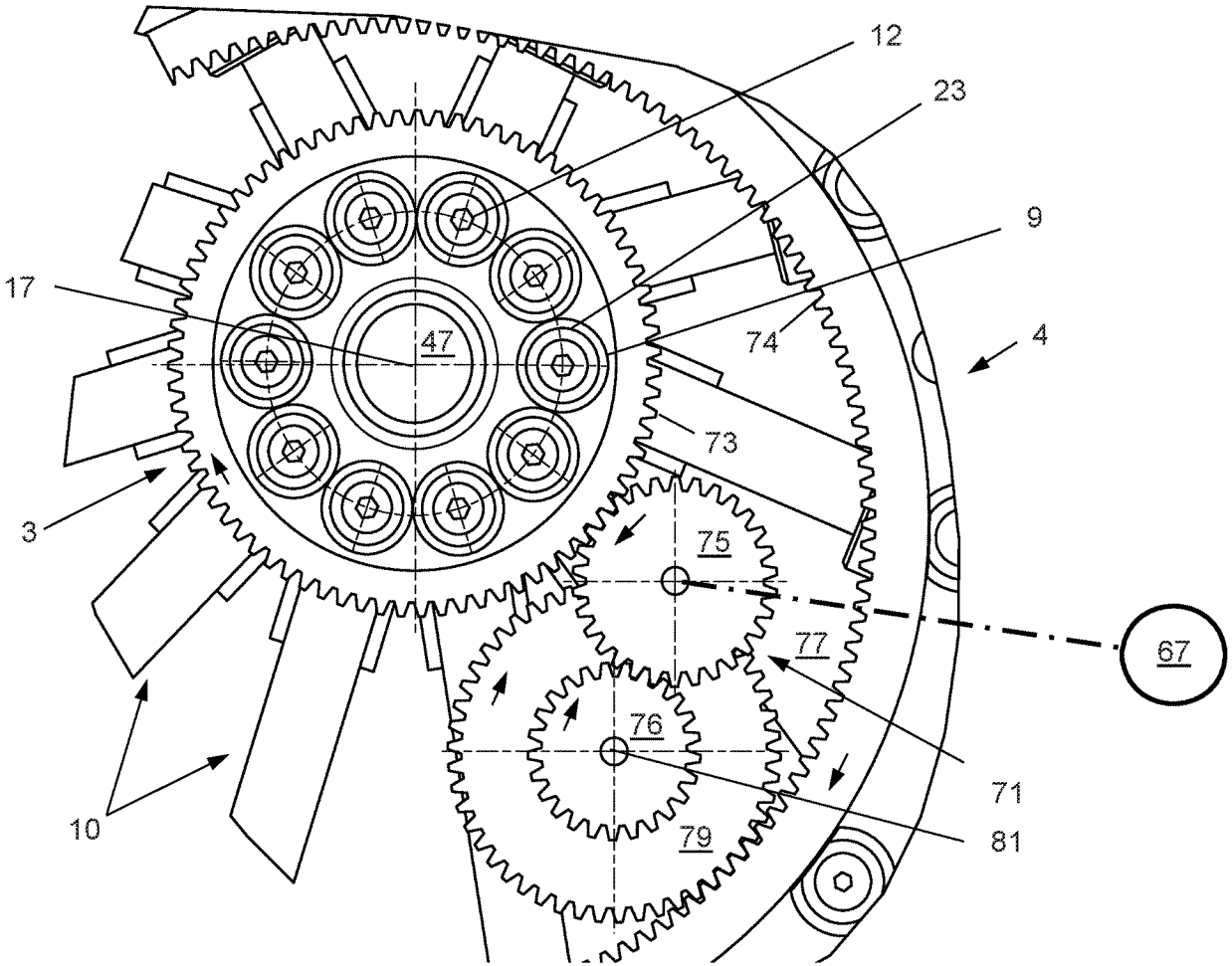
FIG. 6 shows an enlarged, perspective representation of the drive for the inventive apparatus.

The central wheel 3 and the carrier wheel 4 are driven with the aid of a thereto connected joint drive 67, e.g. a servomotor (FIG. 6). For this, the drive 67 is directly connected via an additional drive element, e.g. a toothed belt or a drive chain, to a first gear wheel 75 of a toothed gearing, embodied as power transmission element 71. The gear wheel 75 engages in an outside toothing 73 of the central wheel 3 and drives this wheel 3. By way of two rigidly connected additional gear wheels 76, 79, the first gear wheel 75 also drives the carrier wheel 4 in the same rotational direction as the central wheel 3. The inside diameter of the carrier wheel 4 is provided for this with an inside toothing 74. To be able to adjust the angle position between the central wheel 3 and the carrier wheel 4 during the assembly and/or for plant adjustments and/or when starting the operation of the transfer conveyor 20, it may be necessary to adjust the additional gear wheels 76, 79 which are rigidly connected during the operation, relative to each other around their joint rotational axis 81. The gear wheels 75, 76, 79 of the power transmission element 71 are connected tightly to the machine frame 100 and, as shown in FIG. 6, are arranged inside the carrier wheel 4 in a clearance space 77 between the central wheel 3 and the carrier wheel 4, thus resulting in a space-saving and compact construction. The number of teeth on the gear wheels 75, 76, 79 of the power transmission element 71 is selected such that the carrier wheel 4 runs at the same speed and in the same rotational direction as the central wheel 3, meaning these gear wheels always rotate synchronously and in the same rotational direction.

It is furthermore conceivable that the drive 67 is not connected directly to the first gear wheel 75, but to the central wheel 3, with one of the other gear wheels 76, 79, or with the carrier wheel 4. With the arrangement of the toothed gears 3, 4, 75, 76 and 79, shown in FIG. 6, the gear wheels which are respectively not connected directly to the drive 67 would still be driven in the same way as described in the above. In a further, non-depicted embodiment, the central wheel 3 and the carrier wheel 4 can also be driven with the aid of a toothed belt that is connected to the drive shaft of the drive 67, instead of with the power transmission element 71 embodied as gear transmission.

During the operation of the above-described apparatus, the advertising material compilations 2 are transferred by the feed conveyor 21 to the transfer conveyor 20, are transported by this conveyor to a stacking device 44 and are deposited and stacked thereon.

In a first step, the advertising material compilations 2 are transported by the feed conveyor 21 with a first speed in a feeding plane 24, shown in FIG. 2, either positioned flat on the feed conveyor 21 or clamped between an upper and a lower belt of the feed conveyor 21. The transport between two belts is especially advantageous if the advertising material compilations 2 are loose inserts 2*b* which are simply stacked one on top of the other or which are easily separated. It is furthermore conceivable that a pusher known from the prior art, which is not shown herein, pushes the advertising material compilation 2 by the trailing edge or that the advertising material compilation is held by a gripper of the feed conveyor by its leading or trailing edge or one of the side edges and is thus supplied to the transfer conveyor 20. The advertising material compilations 2 are transported while spaced-apart by the feed conveyor 21, so that a gap exists between respectively two successive advertising material compilations 2 into which the respective gripper 1 of the transfer conveyor 20 is pivoted in the takeover region 27. The feeding plane 24 is shown horizontally in FIGS. 1 and 2. Conceivable are also feed conveyor 21 arrangements for which the feeding plane is arranged at an angle or vertically in transporting direction for the advertising material compilations 2.

In the following step, the advertising material compilations 2 are taken over in the takeover region 27 by the grippers 1 which are attached to the pivoting arms 10. As can be seen in FIG. 2, the gripper 10.1 extends through the feeding plane 24 in front of the takeover region 27 by being inserted into the gap between two advertising material compilations 2. The gripper 1 is opened with the upper opening and closing cam curve 41 prior to the takeover region 27 and is pivoted with the cam-controlled adjustment element 6 in such a way around the axis 50 of the holding element 5 that the advertising material compilation 2 is moved from the feed conveyor 21 to between the clamping jaws 18*a*, 18*b* of the gripper 1. The circumferential speed of the gripper 1 in the takeover region 27 is lower than the speed of the feed conveyor 21. The control of the feed conveyor 21 speed, the control of the rotational speed of the transfer conveyor 20, as well as the clocking in of the two conveyors relative to each other takes place in a manner known per se through the superimposed control unit 80. For a secure and careful transfer of the advertising material compilations 2 to the transfer conveyor 20, it is advantageous if at least in the takeover region 27, the feeding plane 24 extends parallel to the rotational axis 17 of the transfer conveyor 20 and if the feeding plane 24 is arranged approximately tangential to a movement path 25 for the grippers 1. The grippers 1 are aligned in the takeover region 27 with the aid of the cam curve 70 and the adjustment element 6, such that the advertising material compilations 2 can be inserted into the opened grippers 1, meaning into the opening between the clamping jaws 18*a*, 18*b* without colliding therewith. The gripper 1 is closed as the end of the takeover region 27, as soon as the advertising material compilation 2 can be gripped securely by the clamping jaws 18*a*, 18*b*. The length of the segment of the advertising material compilation 2 that is inside the gripper 1, for example, depends on the characteristics (format, thickness, weight, roughness of the surface) or the processing speed. The start and the course of the closing operation of the gripper 1 is determined by the upper opening and closing cam curve 41 and the cam follower 53 rolling off thereon which is connected to the gripper 1. The gripper 1 is closed as a result of the prestressing of the elastic element 19 which also determines which force holds the advertising material compilations 2 between the clamping jaws 18*a*, 18*b*. At the end of the takeover region 27, once the gripper 1 is closed and the advertising material compilation 2 is held securely by the gripper, the gripper 1 is positioned relative to the pivoting arm 10 in a position where it is pivoted to a maximum degree around the axis 50, counter to the direction of circulation of the transfer conveyor 20. This is also obvious from the course of the cam track 70 in FIGS. 1 and 2, in which the cam follower 57 of the pivoting arm 10.2 is guided in a cam track 70 segment that is relatively close to the rotational axis 17. After the takeover region 27 the gripper 1 rotates around the axis 50 in the direction of circulation of the transfer conveyor 20.

Compared to thin advertising material compilations 2, very thick advertising material compilations 2 come much earlier in contact with the clamping jaws 18*a*, 18*b* during the takeover by the gripper 1 and are clamped in. So that the section of the advertising material compilation 2 that is located inside the gripper 1 has the length required for a secure transport and depositing on the stacking device 44 for thin as well as thick advertising material compilations 2, the upper opening and closing cam curve 41 can be embodied adjustable around the rotational axis 17 in or counter to the rotational direction of the transfer conveyor 20 or can be embodied replaceable.

During a further step, the grippers 1 transport the advertising material compilations 2 along the circumference of the transfer conveyor 20 to the transfer region 28 in which the advertising material compilations 2 are deposited on a stacking device 44. Owing to the eccentric arrangement of the first rotational axis 17 of the central wheel 3 to which the inside end 13 of the pivoting arm 10 is attached so as to rotate, and the second rotational axis 16 of the carrier wheel 4 in which the pivoting arms 10 are positioned between the inside end 13 and the outside end 14, the spacing between two adjacent grippers 1 changes constantly during the operation. Owing to the changing spacing 78, the circumferential speed of the grippers is not constant even if the central wheel 3 and the carrier wheel 4 are driven with a constant speed and synchronously. If the spacing 78 between two adjacent grippers 1 is large, the circumferential speed of the grippers 1 is also high; if this spacing 78 is small, the circumferential speed of the grippers 1 is low. As shown in FIG. 2, the relatively large spacing 78 in the takeover region 27 between two adjacent grippers decreases during the further path of these grippers to the transfer region 28. Accordingly, the circumferential speed of the grippers 1 and therein transported advertising material compilations 2 is also reduced. Controlled by the cam curve 70, the gripper 1 pivots around the axis 50 during the rotation of the pivoting arm 10, relative to this arm. The cam follower 57 of the adjustment element 6 is then in a section of the cam curve 70 which is relatively far from the rotational axis 17. The trailing end of the advertising material compilation 2, which is at a distance to the folded edge 2*c* and is not held by the gripper 1 moves radially toward the outside around the axis 50 as a result of the pivoting of the gripper 1. The aligning of the advertising material compilations 2, which are already delayed but still held by the grippers 1, with the depositing plane 45 on which the advertising material compilations 2 are deposited is thus closer (see advertising material compilation 2 in the gripper 10.5; FIG. 2).

In a further step, the grippers 1 are opened in the transfer region 28 through the opening and closing cam curve 42, and the advertising material compilations 2 are transferred to the stacking device 44 and placed on top of the upper advertising material compilation 2 already on the stack 43. It is advantageous in that case if the stacked advertising material compilations 2 can be aligned on an end stop 46 of the stacking device 44. As seen from the side and shown in FIG. 2, the end stop 46 extends into the movement path 25 of the grippers 1 and is provided for this with a non-depicted recess for the gripper 1. The advertising material compilations 2 are controlled in this way and softly brushed off at the end stop 46. The stacking device 44 is connected to the control unit 80 which, following the transfer of an additional advertising material compilation 2, further lowers the stack 43 corresponding to the thickness of an advertising material compilation 2. The position of the depositing plane 45 thus remains nearly constant and a collision is avoided between the gripper 1 and the stack 43 forming in downward direction. A free and uncontrolled drop of advertising material compilations 2 can be prevented in the same way, which can be the result of a depositing plane 45 that moves downward too quickly. The thickness value of the advertising material compilations 2 necessary for controlling the lowering of the stack 43 is stored in the control unit 80, is calculated by this unit, or is transmitted from a measuring site in the conveyed flow of compiled advertising materials 2 to the control unit 80. The lowering of the stack can also be controlled with a level control, arranged at the upper end of the stack 43 via a non-depicted adjustment element, for example a light barrier.

In a further step and following the transfer of the advertising material compilation 2 to the stacking device 44, the spacing 78 between two adjacent grippers 1 is increased until a renewed entry into the takeover region 27 and the grippers 1 are closed by means of the lower closing and opening cam curve 42. It is advantageous if, following the transfer of the advertising material compilations, the grippers 1 are swiveled relative to the pivoting arm 10 around the axis 50, counter to the circulating direction of the transfer conveyor 20 since the outside diameters of the transfer conveyor 20 can thus be kept at a minimum between the transfer region 28 and the takeover region 27. It is also conceivable that downstream of the transfer region 28 the grippers 1 in the opened state rotate around the axis 17 until they again take over an advertising material compilation 2. For this, the upper and lower opening and closing cam curves 41, 42 between the transfer region 28 and the takeover region 28 could be connected.

It will be understood that the above description of the present invention is susceptible to various modifications, changes and adaptations, and that the same are intended to be comprehended within the meaning and range of equivalents of the appended claims.

What is claimed is:

1. An apparatus for forming a stack with advertising material compilations composed of, respectively, an envelope, inserts inside the envelope, the envelope having a common, leading folded edge, said apparatus comprising:

a machine frame;

a circulating transfer conveyor having a circular shape connected to the machine frame, wherein the transfer conveyor comprises:

a central wheel attached to the machine frame for rotation around a first rotational axis;

a carrier wheel attached to the machine frame for rotation around a second rotational axis that is oriented in a direction that is parallel to the first rotational axis;

a number of pivoting arms radially arranged on the carrier wheel, each pivoting arm including: an inside end respectively arranged to rotate on the central wheel; an outside end and a gripper attached to the outside end for rotation around an axis on the pivoting arm; and a number of guide elements positioned on the carrier wheel for, respectively, slidingly supporting one of the pivoting arms, the second rotational axis being arranged to extend below a horizontal plane through the first rotational axis;

a feed conveyor arranged upstream of the transfer conveyor; and a stacking device arranged downstream of the transfer conveyor;

wherein the transfer conveyor is adapted so that the advertising material compilations are taken over by the grippers of the transfer conveyor from the feed conveyor in a takeover region of the transfer conveyor, and the advertising material compilations are transferred in a transfer region of the transfer conveyor by the grippers of the transfer conveyor to the stacking device which extends into the transfer region.

2. The apparatus according to claim 1, wherein the envelope and the inserts of the advertising material compilations are joined loosely or can be separated easily.

3. The apparatus according to claim 1, wherein an upper opening and closing cam curve and a lower opening and closing cam curve are one of arranged on the machine frame, connected thereto or are attached to a component of the apparatus that does not circulate along with the transfer conveyor for controlling an opening and closing of the grippers.

4. The apparatus according to claim 3, wherein the upper and lower opening and closing cam curves are at least one of adjustable and replaceable to adapt to different advertising material compilations.

5. The apparatus according to claim 1, further including a single drive and a joint power transmission element arranged to drive both the central wheel and the carrier wheel.

6. The apparatus according to claim 5, wherein the central wheel includes an outside toothing and the carrier wheel includes an inside toothing and the power transmission element includes a toothed gearing arranged to engage in the outside toothing and the inside toothing.

7. The apparatus according to claim 5, wherein the power transmission element comprises a toothed gearing arranged between the central wheel and the carrier wheel.

8. The apparatus according to claim 5, wherein the joint power transmission element comprises a toothed gearing.

9. The apparatus according to claim 1, wherein the feed conveyor comprises at least one conveying element with a feeding plane for the advertising material compilations, the feeding plane is oriented parallel to the first rotational axis of the central wheel and tangential to a movement path of the grippers, and the stacking device is arranged along a circumference of the transfer conveyor and comprises a depositing plane oriented parallel to the first rotational axis of the central wheel and one of horizontal or at an acute angle to a horizontal line.

10. The apparatus according to claim 1, wherein the second rotational axis is arranged in a location below a horizontal plane through the first rotational axis and with an offset to the side of the first rotational axis.

11. The apparatus according to claim 1, wherein the carrier wheel comprises two rings which are spaced apart and connected to one another.

12. The apparatus according to claim 11, wherein the two rings include recesses along circumferences of the rings for accommodating the guide elements.

13. The apparatus according to claim 1, further including an adjustment element positioned on each pivoting arm.

14. The apparatus according to claim 1, wherein the carrier wheel completely encloses the central wheel in radial direction.

15. The apparatus according to claim 3, wherein the grippers further comprise a clamping body having a pivoting clamping jaw and a cam follower which cooperates with the upper and lower opening and closing cam curves and wherein said gripper is pressed in a closed position and is opened upon interaction of the cam follower and the upper and lower opening or closing cam curves.

16. The apparatus according to claim 1, wherein a diameter of said carrier wheel is greater than a diameter of said central wheel diameter.

17. The apparatus according to claim 16, wherein said central wheel is positioned completely within said carrier wheel in a radial direction.

18. The apparatus according to claim 1, wherein said second rotational axis is located below a horizontal plane extending through said first rotational axis and is parallel to the first rotational axis, with an offset to a side of the first rotational axis.

19. A method for forming a stack of advertising material compilations composed of, respectively, an envelope, inserts inside the envelope, and having a common, leading folded edge, employing an apparatus including a machine frame a thereto attached circulating transfer conveyor in the shape of a circle, a feed conveyor arranged upstream of the transfer conveyor, and a stacking device arranged downstream of the transfer conveyor, wherein the transfer conveyor includes a central wheel that rotates around a first rotational axis and is attached to the machine frame, a carrier wheel that rotates around a second rotational axis oriented in a direction parallel to the first rotational axis and is also attached to the support frame, and a number of pivoting arms respectively arranged with an inside end on the central wheel so as to rotate, and including respectively one gripper attached to an outside end of the pivot arm for rotation around an axis on the pivoting arm, the method comprising:

taking over the advertising material compilations from the feed conveyor by the grippers of the transfer conveyor in a takeover region of the transfer conveyor;

subsequently transporting, by the grippers of the transfer conveyor, the advertising material compilations to the stacking device in a transfer region of the transfer conveyor, while during the transporting reducing a spacing between adjacent grippers and transporting the advertising material compilations at a reduced speed to the stacking device, and depositing the advertising material compilations on the stacking device;

subsequently, and until a renewed entry into the takeover region, increasing the spacing between the adjacent grippers; and swiveling the grippers relative to their pivoting arm in the takeover region and in the transfer region for alignment with the feed conveyor and the stacking device, respectively.

20. The method according to claim 19, further comprising using advertising material compilations for which the envelope and the inserts are combined loosely or easily separated.

21. The method according to claim 19, the method further including opening the grippers utilizing an opening cam curve prior to coming into the takeover region; and closing the grippers at the end of the takeover region by a closing cam curve.

* * * * *